US006467955B1

(12) United States Patent
Kim

(10) Patent No.: US 6,467,955 B1
(45) Date of Patent: Oct. 22, 2002

(54) SEAMLESS TUBULAR FABRIC BULK CONTAINER

(76) Inventor: Jong H. Kim, 6516 High Meadow Ct., Long Grove, IL (US) 60047

( * ) Notice: Subject to any disclaimer, the term of this patent is extended or adjusted under 35 U.S.C. 154(b) by 0 days.

(21) Appl. No.: 09/862,584

(22) Filed: May 22, 2001

(51) Int. Cl.[7] ..... B65D 33/10; B65D 33/16

(52) U.S. Cl. ..... 383/20; 383/24; 383/41; 383/67; 383/105

(58) Field of Search ..... 383/24, 41, 67, 383/105, 17, 20

(56) References Cited

U.S. PATENT DOCUMENTS

| | | | | | |
|---|---|---|---|---|---|
| 3,827,471 | A | * | 8/1974 | Gregory et al. | 383/67 |
| 3,893,595 | A | * | 7/1975 | Khanna et al. | 383/67 |
| 4,362,199 | A | * | 12/1982 | Futerman | 383/24 |
| 4,573,204 | A | * | 2/1986 | Polett | 383/41 |
| 4,658,432 | A | * | 4/1987 | Lehmann et al. | 383/20 |
| 4,807,299 | A | * | 2/1989 | Nattrass | 383/109 |
| 4,917,266 | A | * | 4/1990 | Kellenberger et al. | 383/67 |
| 4,917,507 | A | * | 4/1990 | Davidson | 383/67 |
| 5,104,236 | A | * | 4/1992 | LaFleur | 383/67 |
| 5,108,196 | A | * | 4/1992 | Hughes | 383/20 |
| 5,340,217 | A | * | 8/1994 | Rothman | 383/20 |
| 5,358,335 | A | * | 10/1994 | LaFleur | 383/24 |
| 5,564,833 | A | * | 10/1996 | Proffitt | 383/22 |
| 5,607,237 | A | * | 3/1997 | LaFleur | 383/22 |
| 6,056,440 | A | * | 5/2000 | Nattras | 383/109 |

FOREIGN PATENT DOCUMENTS

| | | | | |
|---|---|---|---|---|
| EP | 342012 | * | 11/1989 | 383/17 |
| EP | 411683 | * | 2/1991 | 383/17 |
| GB | 2132171 | * | 7/1984 | 383/20 |

* cited by examiner

*Primary Examiner*—Stephen P. Garbe
(74) *Attorney, Agent, or Firm*—Mark E. Wiemelt

(57) ABSTRACT

This invention relates to improvements in bulk containers, and more particularly to seamless tubular fabric bulk containers for facilitating the transport of milk powder for human consumption, or any other flowable powders or grains, including animal feed or grain, from a commercial manufacturer or grain silo to the farm and for facilitating the feeding of farm animals. The improved bulk container comprising a top, a bottom, and a plurality of sides comprising, a seamless vertical member, said vertical member being elongated, said vertical member having a first and a second end, said first end of the vertical member being affixed to the top of the bulk container and the second end of the vertical member being affixed to the bottom of the bulk container. The bulk container has four lifting straps; said lifting straps being opposedly affixed to the first end of the vertical member, and having a means for reinforcing said bulk container when said bulk container is filled, said reinforcing means comprising a vertical reinforcing member and a reinforcing member, said vertical reinforcing member comprising a beginning and an end, said vertical reinforcing member being wovenly engaged vertically to the vertical member, said reinforcing member comprising a beginning and an end, said reinforcing member being affixed circumferentially to the first end of said vertical member, said reinforcing member affixedly engaging the vertical reinforcing member and the lifting straps.

4 Claims, 7 Drawing Sheets

SEAMLESS TUBULAR FABRIC BULK CONTAINER

FIELD OF THE INVENTION

This invention relates to improvements in bulk containers, and more particularly, to seamless tubular fabric bulk containers for facilitating the transport of milk powder for human consumption, or any other flowable powders or grains, including animal feed or grain, from a commercial manufacturer or grain silo to the farm and for facilitating the feeding of farm animals.

BACKGROUND OF THE INVENTION

Modem materials handling systems for milk powder for human consumption, or any other flowable powders or grains, including animal feed or grain, are chosen for a variety of reasons, most having to do with costs. Whether it is minimizing the amount of physical labor by workers, speeding the manufacturing process, or reducing handling costs and wasted product during shipment, storage, and eventual use by the farmer or consumer, an attempt is made to cut costs. In the case of milk powder for human consumption or agricultural feed products the bulk container for use in the packaging of the product can help to cut these costs.

A bulk container for products must provide certain advantages to its users including streamlining the processes associated with the packaging and warehousing of products for the manufacturers, simplifying the handling of products for those persons responsible for transporting the products, and improving the ease of handling, storage, and use of the products by the farmer or consumer. The bulk container also must provide for the product to arrive at the farmer or consumer intact, and there should be no loss of the product due to damage or infestation by mold, vermin, or contamination by other environmental concerns. Therefore, the design of a bulk container for such product must take into account the method for handling the bulk container at each step of the life cycle of the product to ensure that the handling process is cost effective and that the product that reaches the farmer or consumer is of the highest quality.

Farmers are the ultimate users of the animal feed products and historically have used animal feed products in loose form, or in relatively small and easy to handle containers such as burlap or paper bags. These historical methods involved higher handling and storage costs, and the prepared animal feed products often were susceptible to contamination, waste, and poor controls over quality and quantity used. For example, farmers historically have used loose feed stored in silos or other out buildings for feeding animals, and this required extensive labor to distribute the feed to the point of use, e.g., to the barn or point of feeding, it was prone to spillage and waste during transport from the storage location to the point of use, and while in storage the loose feed often suffered contamination from mold, vermin, or other environmental concerns. Historically, farmers also have used animal feed products that were distributed by the production facility in burlap or paper bags. These bags also presented storage and handling problems, they added to the cost of the farming operation, and these bags were subject to contamination from mold, vermin, or other environmental concerns. Farmers have also used and they continue to use other methods for handling prepared animal feed in various forms of packages and in loose form, and the problems associated with these other methods are similar to, and have already been illustrated by, the foregoing.

In agriculturally progressive areas, such as Japan, the United States, Canada, and many parts of Europe, modern agriculture has become big business, and the farmer is more and more a manager, running a business, which may be part of a huge corporation. The goal of the farmer is the same as for any businessman: to maximize profits. The farmer must be alert to government regulations and health standards governing feeding of animals used in the human food chain, and he must be aware of the newest feed handling and storage methods, their compliance with the health regulations, and their cost advantages. The design of a bulk container used for animal feed plays an important part in the overall success of an agribusiness, because it affects the cost of managing the feeding process, the quality of the feed, compliance with health regulations, and the amount of production realized in the animals. The advent of bulk containers for packaging animal feed products provides the modern farmer with a greater number of controls over feeding costs than farmers have historically had available to them.

SUMMARY OF THE INVENTION

The instant invention overcomes the shortcomings of existing methods and devices used for packaging, transporting, storing and using milk powder for human consumption, or any other flowable powders or grains, including animal feed or grain, from a commercial manufacturer or grain silo to the farm and for facilitating the feeding of farm animals. This invention is an improved bulk container that features four sides that comprise a seamless tubular fabric vertical member sewn to a bottom and a top. The seamless vertical member prevents contamination of the animal feed product from foreign material entering through a vertical seam. The top is fitted with a top spout including a tie-off for filling and sealing the bulk container, and the bottom is fitted with a discharge porthole covered by a porthole cover that is sewn into the fabric. A movable bottom cover is attached in a hinge like fashion at one of its edges to the bottom, where the bottom and the vertical member are sewn together. The bottom cover is reinforced and it can be secured in the closed position for transport and storage of the bulk container. When the bulk container is positioned in the feeding area the bottom cover can be opened to expose the porthole cover, and the porthole cover can be perforated to allow the feed material to flow by gravity and be released for feeding. Four lifting rings are attached near the top of the vertical member for lifting the bulk container.

The design of the present invention provides for integral strength of the fully loaded bulk container by calling for the construction of the vertical member to include seamless construction and vertical reinforcement areas that are integrated into the sides and oriented in the vertical dimension of the vertical member. The seamless design of the vertical member provides for greater structural integrity preventing the intrusion of dirt, pests, moisture, and other environmental concerns into the feed products during transportation and storage. The design also requires that the free ends of the lifting rings be oriented so that they overlap the vertical reinforcement areas. The design of the bulk container further calls for these components to be linked together by a reinforcing member that is affixed near the top of the vertical member and oriented perpendicularly to the reinforcement areas and the free ends of the lifting rings. The lifting rings provide a stable means for securing the bulk container during filling, and they can be used to lift the bulk container, e.g., with a fork lift or crane in the manufacturing facility or with a tractor on the farm.

The design of the present invention takes into account the method for handling the bulk container at each step of the life cycle of the animal feed product to ensure that the handling process is cost effective and that the product that reaches the farmer is of the highest quality. This handling equipment can be categorized as working over short distances or as working over long distances. For example, such equipment designed for use over short distances includes equipment for handling the bulk containers of animal feed inside the plant, equipment for loading and unloading the bulk containers before and after transport, and equipment used by the farmer for storing, handling and using the bulk feed packages. Among the variety of industrial vehicles used for the handling of bulk feed packages are trucks, tractors, forklifts, cranes and hoists for vertical and horizontal movement, and elevators for solely vertical movement. Long-distance equipment includes land, sea, and air-transport vehicles and includes automobiles, semi-trucks, trailers, and rail cars, self-propelled ships of all sizes, and various forms of air transportation. The design of the bulk container chosen dictates the preferred method of transport over long and short distances, and this can ultimately add to the cost of the animal feed to the farmer.

The handling of animal feed can be a costly and time intensive component of the operation of an agricultural business. Therefore, the design of a bulk container for animal feed must take into account the cost of handling animal feed products once they reach the farm where the feed is used. Similarly, the design of a bulk container for animal feed can affect the quality of the animal feed. Therefore, the costs realized by a farmer for feeding his animals can depend in large part on the design of the bulk container chosen for the animal feed product.

The object of the present invention is to provide the modem commercial animal feed processor, grain silo operator, and the farmer with a pre-packaged bulk container for animal feed designed around materials management principles to provide a cost effective means for packaging, transporting, storing, and using animal feed products, and to describe a design that will overcome the problems and reduce the costs historically associated with loose and prepackaged animal feed products. A further object of the present invention is to provide a bulk container that is large enough to reduce the time and expense associated with handling smaller burlap or paper containers. A further object of the present invention is to provide a bulk container that is capable of being lifted and moved with the type of equipment typically found on the modem farm, e.g., it is strong enough to be lifted with a forklift or a tractor based implement. A further object of the present invention is to provide a bulk container that is made of woven fabrics and that is assembled so that the bulk container will keep the animal feed clean, and free from infestation by molds, vermin, and other environmental concerns. A further object of the present invention is to provide an improvement in bulk containers, and more particularly, to seamless tubular fabric bulk containers for facilitating the transport of animal feed from a commercial manufacturer or grain silo to the farm and for facilitating the feeding of farm animals. Thus, a further object of the present invention is to provide the modem producer of animal feed products and the farmer with a bulk container for animal feed products that costs less to use and that provides animal feed that is of the highest quality.

DETAILED DESCRIPTION OF THE INVENTION

Figure 2:
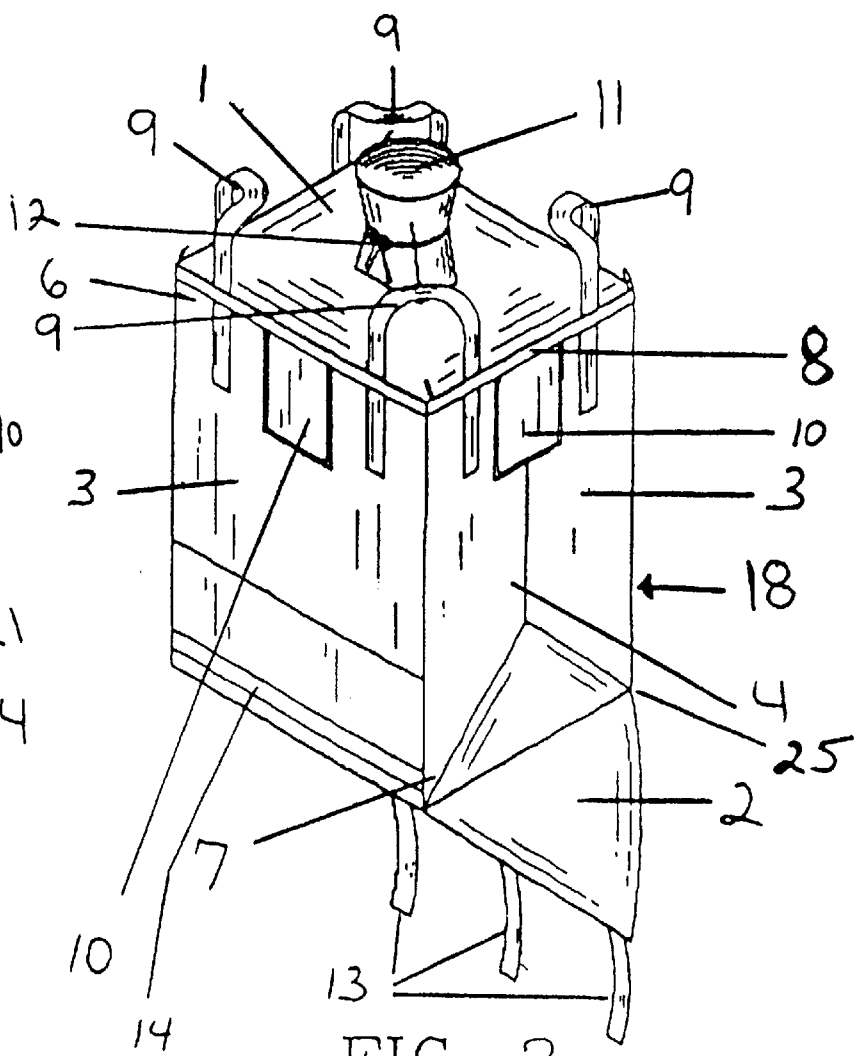
FIG. 2 shows a combination front and side elevational view from above the bulk container with the bottom cover 2 in the opened position.

The present invention is directed to a bulk container for packaging, transporting, storing and using milk powder for human consumption, or any other flowable powders or grains, including animal feed or grain, from a commercial manufacturer or grain silo to the farm and for facilitating the feeding of farm animals. The drawings accompanying this description depict a preferred embodiment of the invention which can be formed in a variety of ways. While the description will proceed with respect to the drawings, it will be readily understood by those skilled in the art that such descriptions and drawings are used to explain the novel features of the invention, rather than in any limiting sense.

Referring to the drawings in detail, and particularly FIGS. 1 through 13, reference character 18 generally indicates a bulk container for animal feed products. The instant invention overcomes the shortcomings of existing methods and devices used for packaging, transporting, storing and using animal feed products. The preferred embodiment is an improved bulk container 18 that features four sides 3 that comprise a seamless tubular fabric vertical member 4 sewn to a bottom 17 and a top 1. The seamless vertical member 4 prevents contamination of the animal feed product from foreign material entering through a vertical seam. The top 1, bottom 17, and sides 3 are constructed of a 6.5 ounce uncoated polypropylene fabric, although it will be readily understood by those skilled in the art that coated or uncoated polypropylene, polyester or polyethylene may suffice.

Figure 6:
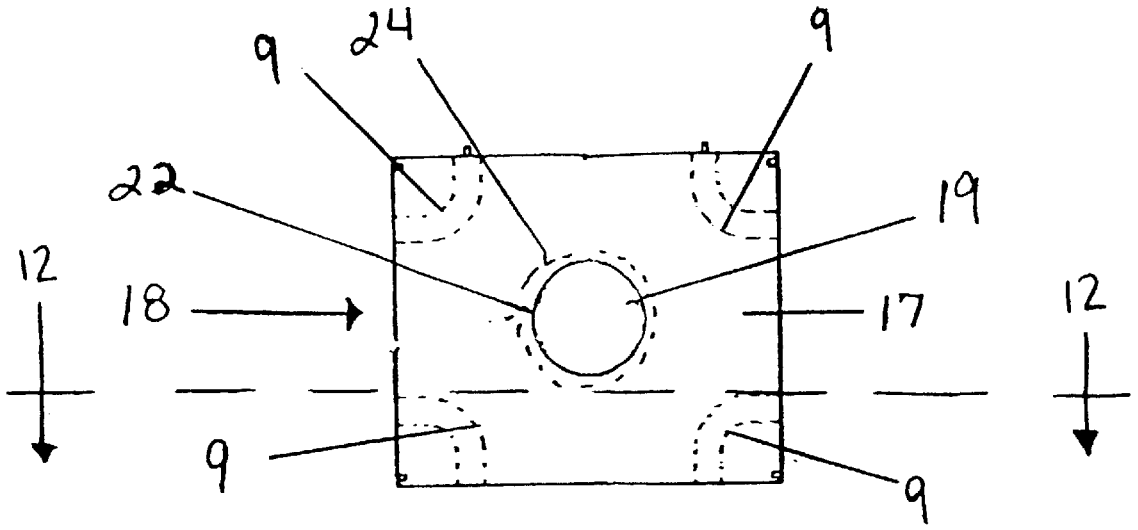
FIG. 6 is a bottom perspective showing the porthole cover 16.

The top 1 is fitted with a top spout 11 including a tie-off 12 that is made of polypropylene fabric that is sewn into the top 1 for filling and sealing the bulk container 18, and the bottom 17 is fitted with a discharge porthole 19 covered by a two mil polyethylene film porthole cover 16 that is sewn to the fabric, although it will be readily understood by those skilled in the art that coated or uncoated polypropylene, polyester or polyethylene may suffice. The edge 22 of the porthole 19 is reinforced with folded fabric 23 from the bottom 17 and sewing 24. The sewing 24 also sews the porthole cover 16 to the bottom 17 in order to cover the porthole 19, as shown in FIG. 6. The porthole cover 16 is sized to fit over the porthole 19. The porthole cover is sized to have a diameter larger than the diameter of the porthole. The porthole cover is sewn to the fabric and covers the porthole so contents of the bulk container do not exit the porthole. The porthole cover is made of two mil polyethylene film and can be perforated to allow the contents of the bulk container to discharge through the porthole.

A bottom cover 2 is fabricated of a 6.5 ounce uncoated polypropylene fabric or other similar material and it is attached in a hinge like fashion at one of its edges 25 to the bottom 17 where the bottom 17 and the vertical member 4 are sewn together. The bottom cover 2 is reinforced with three, two and three-quarter inch wide, polypropylene webbing ties 13. At their free ends 26 the webbing ties 13 have two inch wide Velcro® tape 20 attached to them for securing the bottom cover 2 in the closed position when the free ends 26 of the webbing ties 13 are looped through a two by three quarter inch polypropylene belt 14 that is sewn to the second aspect 7 of the vertical member 4.

A lifting means 9 attached to the first aspect 6 of the vertical member 4 for lifting the bulk container 18. It will be readily apparent to one skilled in the art that the lifting means could comprise a hook, a chain, a loop, or a belt. The preferred embodiment of the invention is a lifting ring. The vertical member 4 is constructed with eight vertical reinforcement members 5 (two vertical reinforcement members 5 in each of the four sides 3) that are oriented in the vertical dimension and stitched 27 to the inside surface of the vertical member 4. A vertical reinforcement member 5 comprises a beginning, an end, and 6.5 ounce uncoated polypropylene fabric, although it will be readily understood by those skilled in the art that coated or uncoated polypropylene, polyester or polyethylene may suffice. A vertical reinforcement member 5 runs the substantially the length of the vertical member 4, the beginning of the vertical reinforcement member 5 is located at the first end of the vertical member 4 and the end of the vertical member is located at the second end of the vertical member 4.

Figure 12:
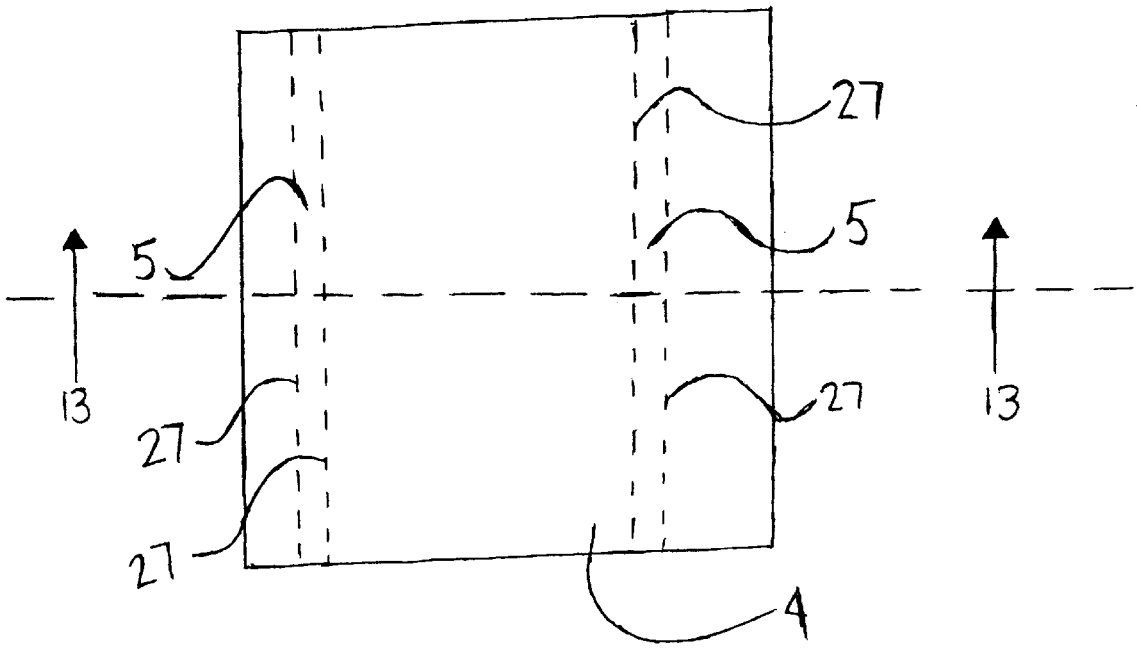
FIG. 12 is a cut-away along line 12—12 in FIG. 6. This figure depicts the vertical reinforcement member 5 affixed to the vertical member 4 by stitching 27.
Figure 13:
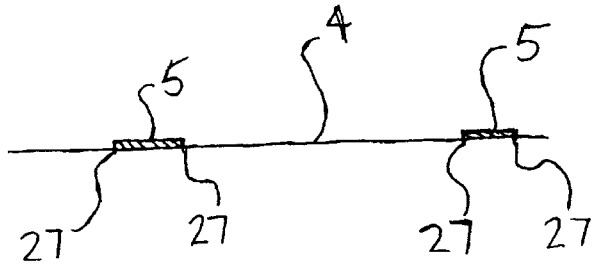
FIG. 13 is a cut-away along line 13—13 in FIG. 12 and serves to illustrate the vertical reinforcement member affixed to the vertical member 4.

The vertical reinforcing member 5 can be stitched 27, woven integrally, or otherwise attached to the inner surface of each side 3 of the vertical member 4. A vertical reinforcement member 5 is located proximate and parallel to the vertical edge of each side 3 of the vertical reinforcement member 4 and is defined by stitching 27, as shown in FIG. 12. There are two vertical reinforcement areas 5 affixed to each side 3 of the vertical member, as shown in FIGS. 12 and 13, making eight vertical reinforcement areas 5 affixed to the vertical member. The free ends 21 of the lifting means 9 are oriented to overlap the vertical reinforcement members 5. The vertical member 4 also has a reinforcing member 8 that is constructed of a single two and three quarter inch wide polypropylene belt affixed to its first aspect 6 and oriented perpendicularly to the vertical reinforcement members 5 and the free ends 21 of the lifting rings 9. By locating the reinforcing member 8 on the first aspect 6 of the vertical member 4, the design provides for the reinforcing member 8 to be affixed collectively to the first aspect 6 of the vertical member 4, the free ends 21 of the lifting rings 9, and to the eight vertical reinforcing members 5.

Figure 1:
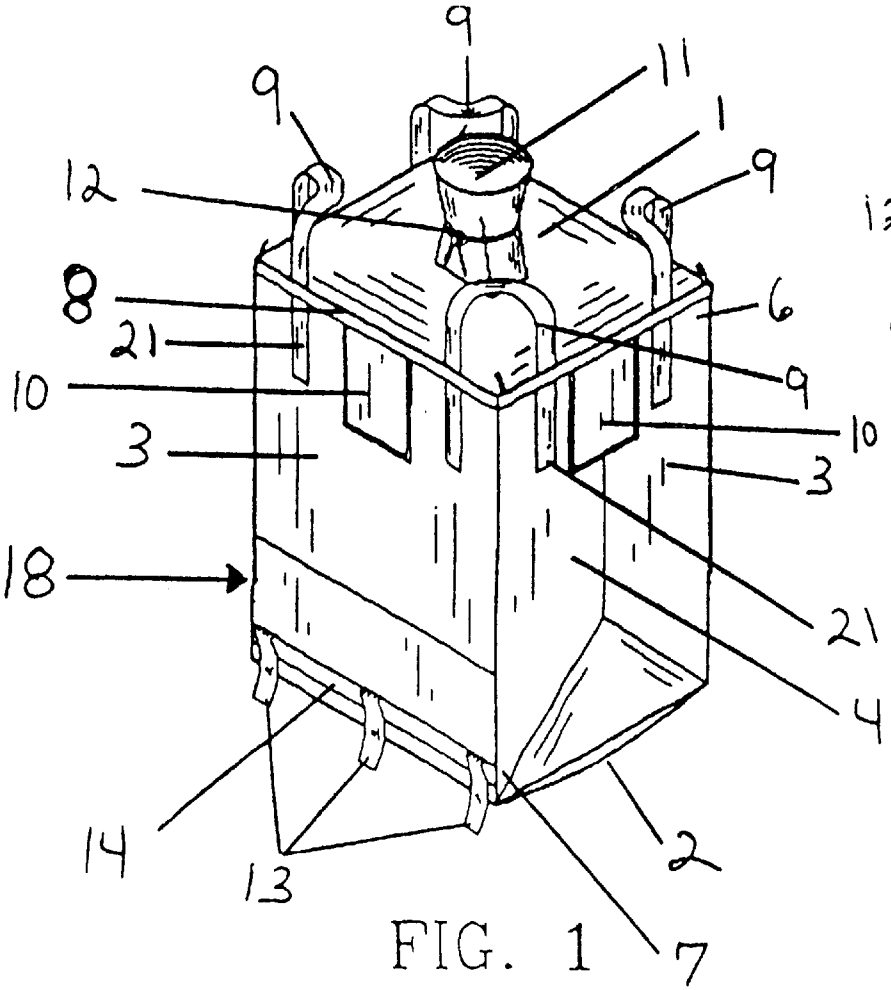
FIG. 1 shows a combination front and side elevational view from above the bulk container with the bottom cover 2 in the closed position.

FIG. 1 shows a preferred embodiment of the bulk container 18 invention which comprises a vertical member 4 having a first aspect 6 and a second aspect 7. The vertical member 4 features four sides 3 that comprise a seamless tubular fabric vertical member 4 sewn to a top 1. The seamless vertical member 4 prevents contamination of the animal feed product from foreign material entering through a vertical seam. The top 1 and sides 3 are constructed of a 6.5 ounce uncoated polypropylene fabric or other similar material. The top 1 is fitted with a top spout 11 including a tie-off 12 that is made of polypropylene that is sewn into the top 1 for filling and sealing the bulk container 18, although it will be readily understood by those skilled in the art that coated or uncoated polypropylene, polyester or polyethylene may suffice. The bottom cover 2 is reinforced with three, two and three-quarter inch wide polypropylene webbing ties 13. Two inch wide Velcro® tape 20 (male and female) is attached to the free ends 26 of the webbing ties 13 for securing the bottom cover 2 in the closed position when the free end 26 of the webbing ties 13 are looped through a two and three-quarter inch wide polypropylene belt 14 that is sewn to the second aspect 7 of the vertical member 4.

Four lifting rings 9 each made of a two and three-quarter inch wide polypropylene belt are attached to the first aspect 6 of the vertical member 4 for lifting the bulk container 18. The vertical member 4 is constructed with eight vertical reinforcement members 5 (two vertical reinforcement members 5 in each of the four sides 3) (FIG. 10) that are oriented in the vertical dimension and affixed to the vertical member 4. The vertical reinforcement members 5 can be woven integrally into the vertical member 4 or they can be constructed of a 6.5 ounce uncoated fabric such as polypropylene and stitched 27 or otherwise affixed to the inside surface of the vertical member 4, although it will be readily understood by those skilled in the art that coated or uncoated polypropylene, polyester or polyethylene may suffice.

Figure 10:
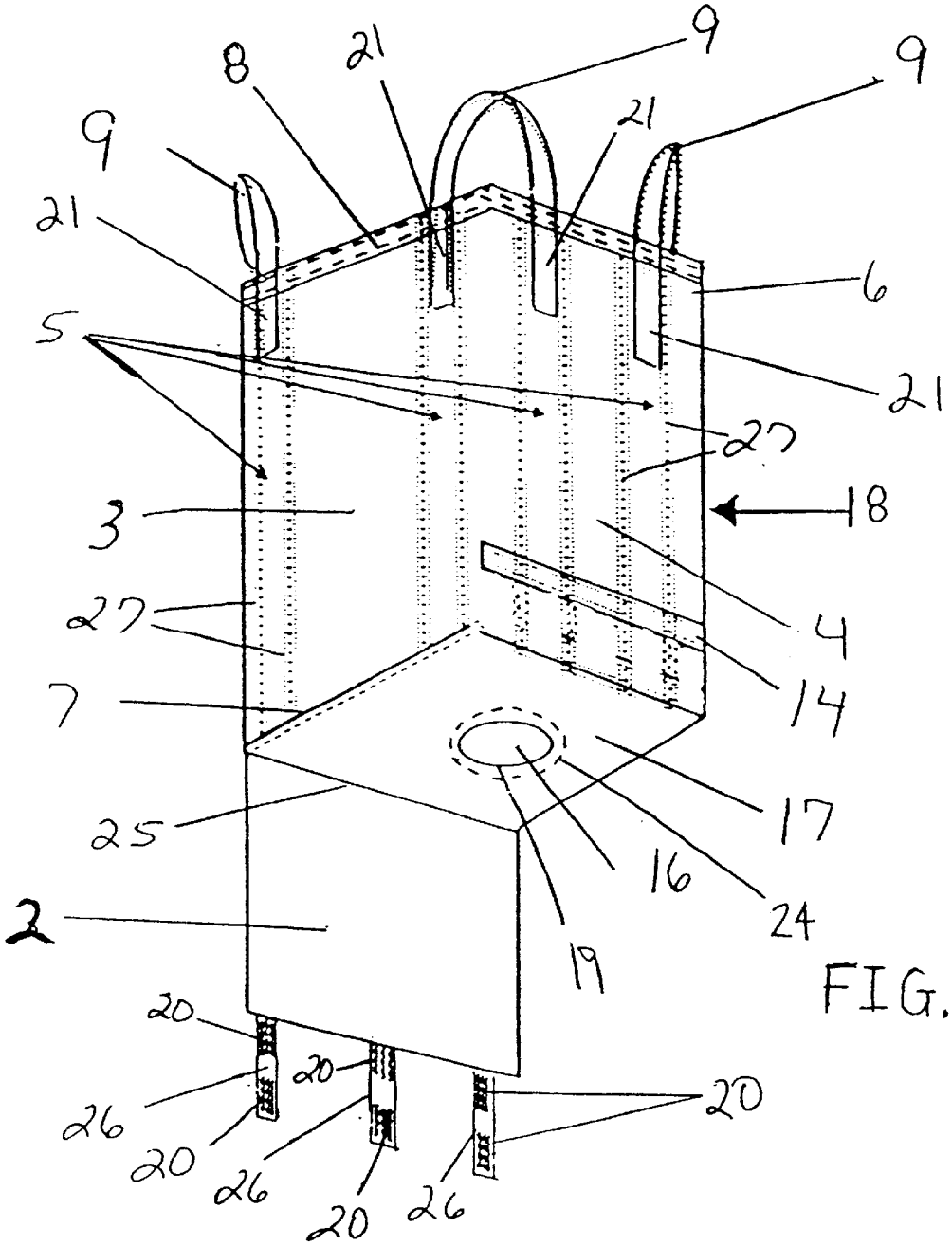
FIG. 10 is a combination front and side elevational view from below the bulk container with the bottom cover 2 in the open position.

The free ends 21 of the lifting rings 9 are oriented to overlap the vertical reinforcement members 5 (FIG. 10). The vertical member 4 also has a reinforcing member 8 that is constructed of a single two and three-quarter inch wide polypropylene belt affixed to its first aspect 6 and oriented perpendicularly to the vertical reinforcement members 5 and the free ends 21 of the lifting rings 9. By locating the reinforcing member 8 on the first aspect 6 of the vertical member 4, the design provides for the reinforcing member 8 to be connected all at once to the first aspect 6 of the vertical member 4, the free ends 21 of the lifting rings 9, and to the eight vertical reinforcing members 5. A document pouch 10 made of a 2 MIL polyethylene is shown attached to the sides 3.

FIG. 2 shows a preferred embodiment of the bulk container 18 invention and discloses the features contained in FIG. 1 except that FIG. 2 discloses the bottom cover 2 in the open position where the Velcro® tape 20 has been released and each free end 26 of the webbing ties 13 has been separated from a single two and three-quarter inch wide polypropylene belt 14 and the bottom cover 2 has been moved to swing into the open position.

Figures 3, 4, 5:
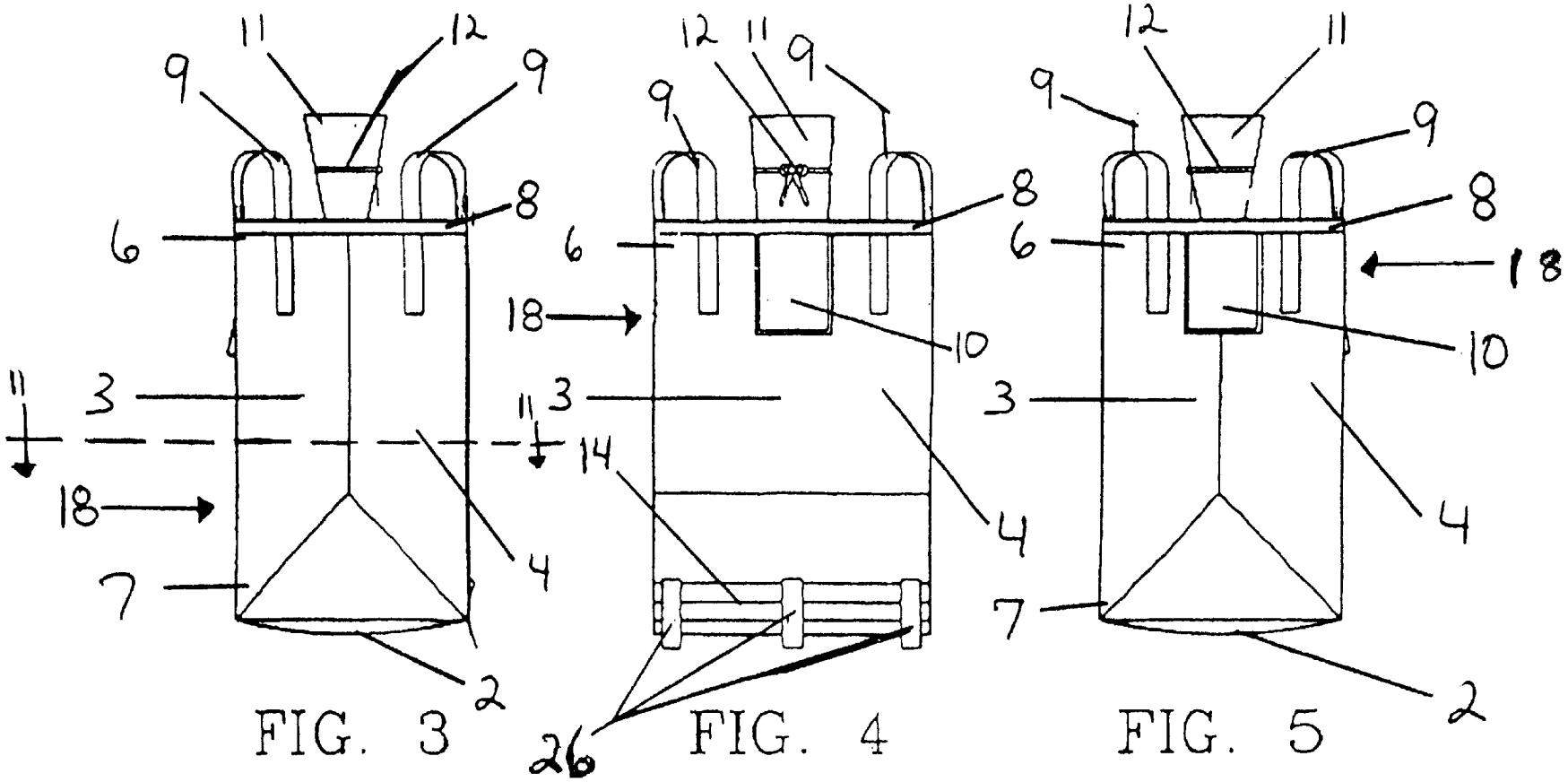
FIG. 3 shows a side view of the bulk container with the bottom cover 2 in the closed position.
FIG. 4 shows a front perspective view the bulk container with the bottom cover 2 in the closed position and secured by the webbing tie 13 shown looped through the locking belt 14.
FIG. 5 shows a side view of the bulk container with the document pouch 9.

FIG. 3 shows a preferred embodiment of the bulk container 18 invention from a side view with the bottom cover 2 in the closed position.

FIG. 4 shows a preferred embodiment of the bulk container 18 invention in a front view and discloses the features contained in FIG. 1 except that FIG. 4 discloses a greater level of detail in the relationship between the free end 26 of the webbing tie 13 and the locking belt 14.

FIG. 5 shows a preferred embodiment of the bulk container 18 invention in a side view with the bottom cover 2 in the closed position, and it also discloses the document pouch 10.

FIG. 6 shows a preferred embodiment of the bulk container 18 invention in a bottom view and discloses the edge 22 of the porthole 19, the sewing 24, and the bottom 17. From this bottom view perspective the viewer can see the outline of the four lifting rings in phantom as illustrated by the broken lines.

Figure 7:
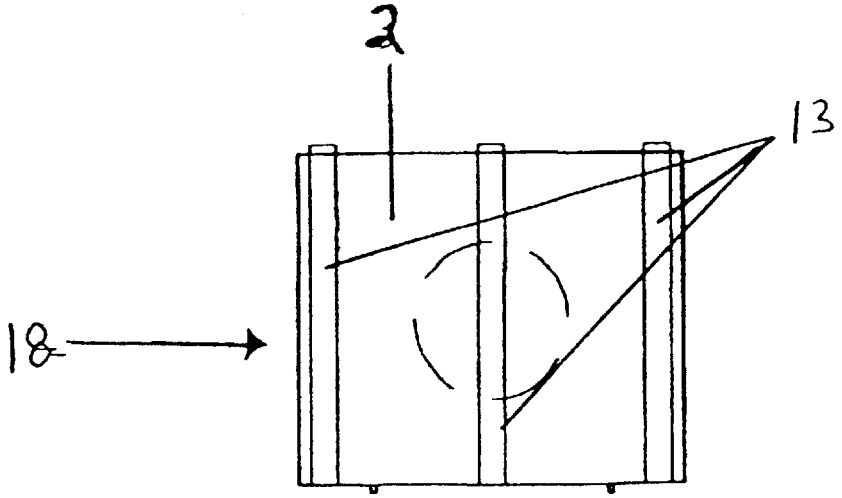
FIG. 7 is a bottom view of the bottom cover 2 in the closed position.

FIG. 7 shows a preferred embodiment of the bulk container 18 in a bottom view and discloses the bottom cover 2 in the closed position with its three reinforcing straps 13. From this bottom view perspective the viewer can see the outline of the porthole 19 superimposed on the image from above.

Figure 8:
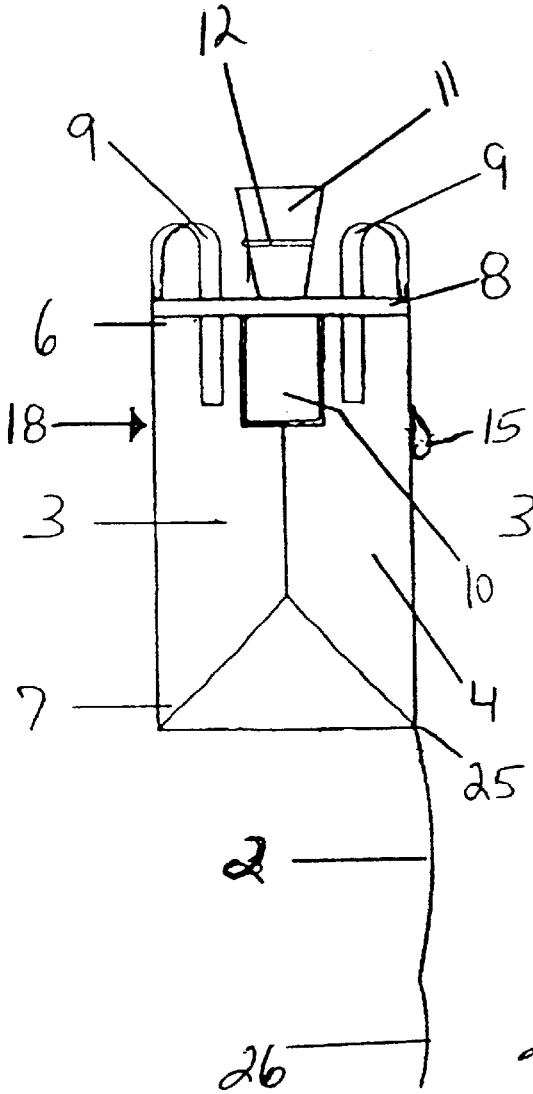
FIG. 8 shows a side view of the bulk container with the bottom cover 2 in the open position.

FIG. 8 shows a preferred embodiment of the bulk container 18 invention in a side view with the bottom cover 2 in the open position, the free end 26 of each of the webbing ties 13 (not shown) hanging freely from the opened bottom cover 2, and it also discloses the document pouch 10. This side view also discloses a one inch wide polypropylene securing ring 15 that can be used for securing the opened bottom cover 2 out of the way during feeding using the Velcro® tape 20 on the free ends 26 of the webbing ties 13.

Figure 9:
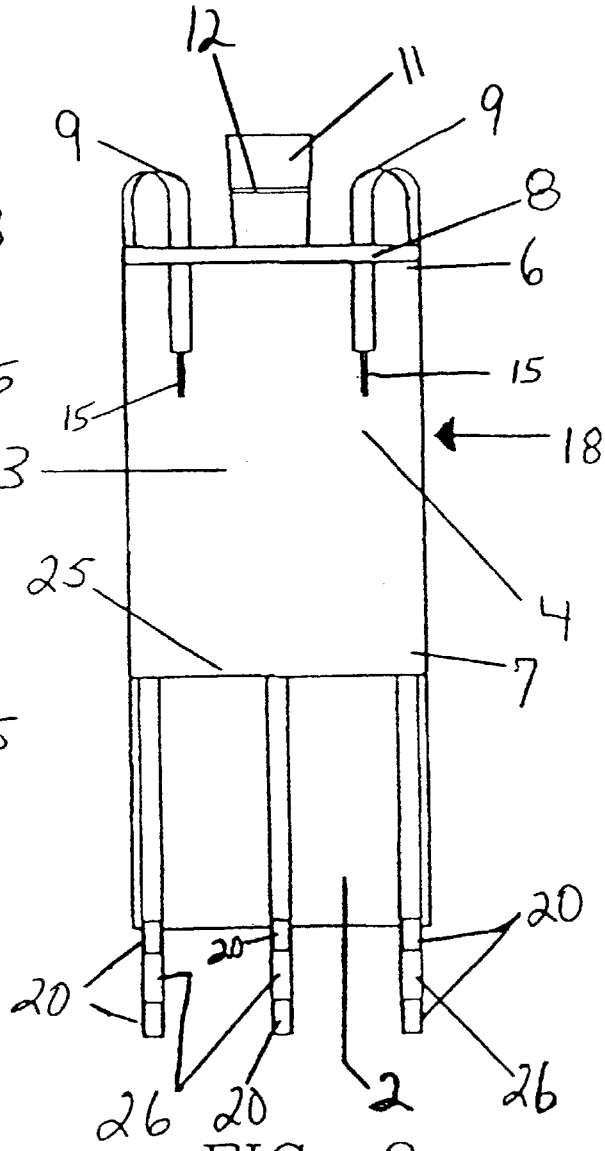
FIG. 9 shows a front perspective view the bulk container with the bottom cover 2 in the open position.

FIG. 9 shows a preferred embodiment of the bulk container 18 invention in a back view with the bottom cover 2 in the open position, and it also discloses the discloses both of the securing rings 15 made of inch wide polypropylene that can be used for securing the opened bottom cover 2 out of the way during feeding. To use the securing rings 15 the user swings the open bottom cover 2 about its edge 25 to the back of the vertical member 4 and affixes it to the securing rings 15 with the free end 26 of the webbing ties 13 using the Velcro tape 20.

FIG. 10 shows a preferred embodiment of the bulk container 18 invention in a bottom view and discloses the porthole 19, the porthole cover 16, and the bottom 17, which are exposed when the bottom cover 2 is in the open position. This FIG. 10 also discloses the relationship between the vertical member 4, the vertical reinforcing members 5, the lifting rings 9, and the reinforcing member 8.

Figure 11:
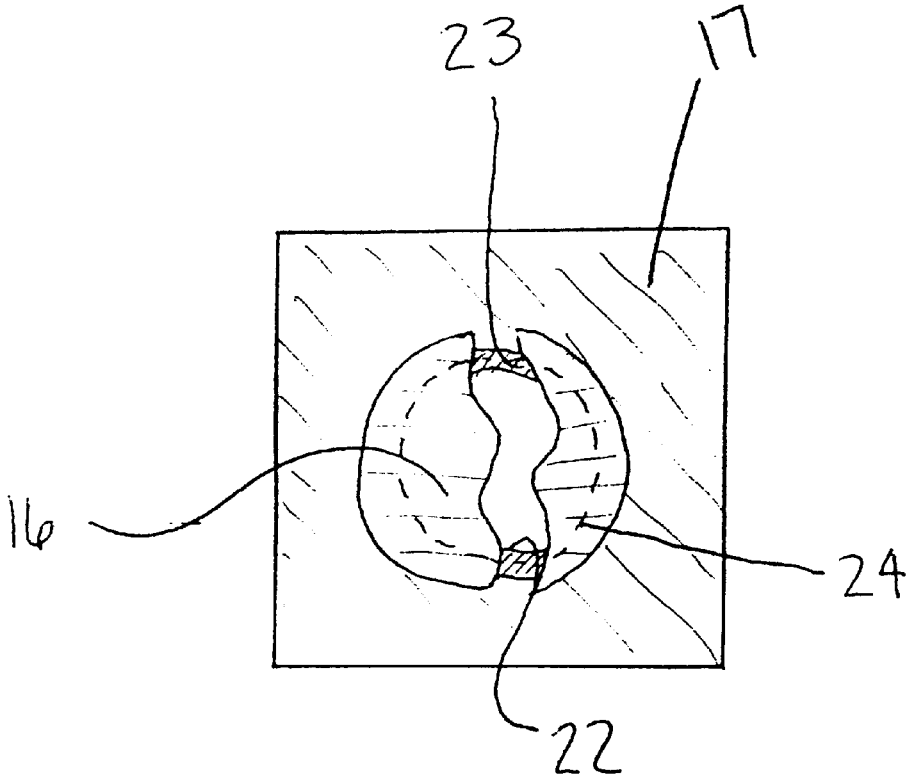
FIG. 11 is a cut-away along line 11—11 in FIG. 3. This view illustrates the porthole cover 16 attached to the bottom 17 by sewing 24.

FIG. 11 is a cut-away along line 11—11 in FIG. 3 and shows an internal view of the bulk container 18 invention facing the bottom 17. This discloses the porthole cover 16, which is cut away to disclose the folded fabric 23 and edge 22 of the porthole. Also, note sewing 24 which affixes the porthole cover 16, to the bottom 17 and the folded fabric 23.

FIG. 12 is a cut-away along line 12—12 in FIG. 6. This internal view of the bulk container 18 invention shows the vertical reinforcement member 5 affixed to the inner surface of the vertical member 4 by stitching 27.

FIG. 13 is a cut-away along line 13—13 in FIG. 12. This side view shows the vertical reinforcement member 5 attached to the vertical member by stitching.

Those of skill in the art will recognize that the bulk container 18 can be made of any strong, durable material, as can any of its component pieces described herein. Moreover, those skilled in the art will recognize that the component pieces that comprise the bulk container 18 can be affixed to the bulk container 18 by stitching, weaving, or by any other method known in the art and that the component pieces can be made from a variety of other materials and composites that are known to be strong and durable in the art.

The foregoing discussion is illustrative of the invention. However, since many embodiments of the invention can be made without departing from the spirit and scope of the invention, the invention resides wholly in the claims hereinafter appended.

What is claimed is:

1. A bulk container comprising:

(a) a top, (b) a bottom, and (c) a plurality of sides comprising, a seamless vertical member, said vertical member being elongated, said vertical member having a first and a second end, said first end of the vertical member being affixed to the top of the bulk container and the second end of the vertical member being affixed to the bottom of the bulk container, (d) said bulk container having four lifting straps; said lifting straps being affixed to the first end of the vertical member;

(e) a porthole, a porthole cover, a bottom cover and a means for securing the bottom cover to the vertical member; and (f) a means for reinforcing said bulk container when said bulk container is filled, said reinforcing means comprising a vertical reinforcement member and a reinforcing member, said vertical reinforcement member comprising a beginning and an end, said vertical reinforcement member being wovenly engaged vertically to the vertical member, said reinforcing member comprising a beginning and an end, said reinforcing member being affixed circumferentially to the first end of said vertical member, said reinforcing member affixedly engaging the vertical reinforcement area and the lifting straps.

2. The bulk container of claim 1 wherein the porthole is located within the bottom.

3. The bulk container of claim 2 wherein the porthole cover covers the porthole and the bottom cover covers the porthole cover.

4. The bulk container of claim 3 wherein the means for securing the bottom cover to the vertical member comprises uncoated polypropylene fabric attaching to the bottom where the bottom and vertical member intersect.

* * * * *